US006716054B1

(12) United States Patent
Denovich et al.

(10) Patent No.: US 6,716,054 B1
(45) Date of Patent: Apr. 6, 2004

(54) PLUG AND BLOCK CONNECTOR SYSTEM FOR DIFFERENTIAL CONTACT PAIRS

(75) Inventors: Sam Denovich, Harrisburg, PA (US); Michael Patrick Green, Mechanicsburg, PA (US); Sheldon Easton Muir, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/321,400

(22) Filed: Dec. 16, 2002

(51) Int. Cl.[7] ..... H01R 4/26

(52) U.S. Cl. ..... 439/404; 439/403; 174/255; 438/106

(58) Field of Search ..... 439/404, 403, 439/49; 174/255; 438/106

(56) References Cited

U.S. PATENT DOCUMENTS 4,964,812 A * 10/1990 Siemon et al. ..... 439/403
5,911,594 A * 6/1999 Baker et al. ..... 439/404
5,915,989 A * 6/1999 Adriaenssens et al. ..... 439/404
6,012,927 A * 1/2000 Longueville et al. ..... 439/65
6,159,020 A * 12/2000 Baker et al. ..... 439/49
6,293,827 B1 * 9/2001 Stokoe ..... 439/608
6,302,699 B1 * 10/2001 Conorich et al. ..... 439/49
6,325,672 B1 * 12/2001 Belopolsky et al. ..... 439/620

* cited by examiner

*Primary Examiner*—Dean A. Reichard
*Assistant Examiner*—Anton Harris

(57) ABSTRACT

A connector plug is provided including a plug body formed along a longitudinal axis and holding multiple contacts arranged in differential pairs. The channels extend along a vertical axis of the plug body and are perpendicular to the longitudinal axis. The channels are grouped in first differential pairs located on a common side of the longitudinal axis adjacent second differential pairs of channels being located on opposite sides of the longitudinal axis. The connector plug also includes a wire guide having a first end configured to join an end of the plug body. The wire guide has a second end configured to receive a cable containing twisted differential pairs of wires. The wire guide has guide slots that carry corresponding twisted differential pairs of wires. The second end has wire dress grooves extending from the guide slots to the channels. Each of the wire dress grooves receives a wire.

24 Claims, 14 Drawing Sheets

14
30
290
226
228
286
288
222
218
214
216
212
34

PLUG AND BLOCK CONNECTOR SYSTEM FOR DIFFERENTIAL CONTACT PAIRS

BACKGROUND OF THE INVENTION

Certain embodiments of the present invention generally relate to a connector system that electrically connects components to one another and more particularly relate to plug and block connectors connecting contacts arranged in differential pairs.

Various electronic systems, such as those used to transmit signals in the telecommunications industry, include connector systems that electrically connect differential pairs of wires with each other. The telecommunications industry uses differential pairs of twisted wires where one wire in each differential pair carries a positive signal and the other wire carries an inverse signal. The differential pair does not include a ground, but instead carries signals intended to have the same absolute magnitude, yet opposite sign. The connector systems include an insulated connector plug and an insulated connector block that connect two separate sets of wires extending from electronic components. The connector plug receives a cable carrying differential pairs of wires. The cable is held in the connector plug. The wires are separated from the cable and each differential pair is untwisted at a neck of the connector plug. Each wire is then carried in a channel to a termination point.

The connector block has a bottom end that receives separate differential pairs of wires. The connector block carries differential pairs of block contacts, while the connector plug carries differential pairs of plug contacts. The plug contacts have first ends configured to engage the wires at the termination points. The block contacts have first ends configured to engage the wires at the bottom end. The block contacts have second ends that have catches configured to engage wires or other contacts. The plug contacts have long crossbeams that intersect at second ends. The catches in the block contacts engage the crossbeams of the plug contacts. Block contacts in a differential pair in the connector block engage corresponding plug contacts in a differential pair in the connector plug. One set of engaging plug and block contacts in a differential pair connect two wires that carry the positive signal. The other set of engaging plug and block contacts in a differential pair connect two wires that carry the negative signal.

However, conventional connector assemblies have several drawbacks. First, the contacts of adjacent differential pairs (within either the connector block or the connector plug) are positioned proximate each other such that unwanted electromagnetic (EM) signal coupling, or cross talk, develops between the contacts of the adjacent differential pairs. The cross talk degrades the quality of the signal transmissions such that the electrical signals may not be deciphered at their destination.

Some connector assemblies have been proposed that afford EM shielding by providing metal divider shields between the differential pairs of contacts. The divider shields act as barriers to electrically isolate the differential pairs of contacts and prevent unwanted EM signal coupling between contacts of adjacent differential pairs. The EM signals cause the divider shields to collect a capacitive charge. Conventional connector assemblies discharge the capacitive charge by connecting the divider shields to ground or interconnecting all of the divider shields such that the charges collected on the divider shields negate each other. However, the divider shields only partially surround the differential pairs of plug and block contacts, and thus differential pairs of plug and block contacts are not fully isolated from charges created by separate differential pairs of plug and block contacts. Also, the divider shields take up extra space within the plug and block connectors and can be difficult to connect to a ground because they are inserted inside of the connector plug and the connector block.

Further, both the plug and block contacts have different geometries from the wires. The difference in geometry creates differences in impedance for differential pairs of plug and block contacts as compared to the impedance of the differential pairs of wires. This impedance mismatch causes a portion of the electrical signals to be reflected at the connector back onto the wires toward the signal source. The amount of signal reflection that occurs due to an impedance mismatch is termed a return loss.

Furthermore, the wires of a differential pair are separated or untwisted at the neck of the connector plug and extend along individual parallel channels to the termination points. The parallel channels in the neck of the connector plug add excess space and length to the connector. When routing the wires, each wire may be terminated at a different length from the neck or may be misrouted causing the wire to be incorrectly terminated at the plug contact. Additionally, depending on the wires and the application, wires in a differential pair should have a predetermined number of twists within a given length of the wire. Controlling the twists per unit of length improves the EM coupling between the wires in a differential pair and inhibits a wire in one differential pair from becoming EM coupled to a wire from an adjacent differential pair. Therefore, untwisting the wires of a differential pair for the distance from the neck to the termination points increases cross talk among the differential pairs of wires.

In certain industries, standards are set for performance requirements of electrical connector assemblies, including a bandwidth for the transmission of signals. New standards have increased the maximum frequency of the bandwidth such that many conventional connector assemblies exhibit unacceptable levels of cross talk and return loss to meet the more stringent frequency requirements.

Thus, a need exists for a connector assembly that reduces cross talk and return loss in a connector system holding multiple differential pairs of contacts.

BRIEF SUMMARY OF THE INVENTION

Certain embodiments of the present invention include a connector plug having a plug body holding multiple contacts arranged in at least one differential pair. The contacts extend along a vertical axis of the plug body. The connector plug also includes a wire guide having a first end configured to join an end of the plug body. The wire guide has a second end configured to receive a cable containing differential pairs of adjacent wires. The wire guide has guide slots and each guide slot carries a corresponding differential pair of wires. The first end of the wire guide includes channels that open onto the second end to receive the contacts. The second end has wire dress grooves extending from the guide slots to the channels. Each of the wire dress grooves receives a single wire.

Certain embodiments of the present invention include a connector plug having a housing guide formed along a longitudinal axis. The housing includes channels that open onto a bottom end of the housing to receive contacts. The channels are grouped in differential pairs including first and second channels located on a common side of the longitudinal axis adjacent differential pairs of channels being located on opposite sides of the longitudinal axis.

Certain embodiments of the present invention include a connector having a housing with a channel extending therethrough between first and second ends of the housing. The connector includes an insert carrying contacts arranged in a differential pair. The channel receives the insert and positions the contacts in a predetermined orientation. The housing is at least partially covered with a conductive substance to shield the differential pair of contacts.

Figure 1:
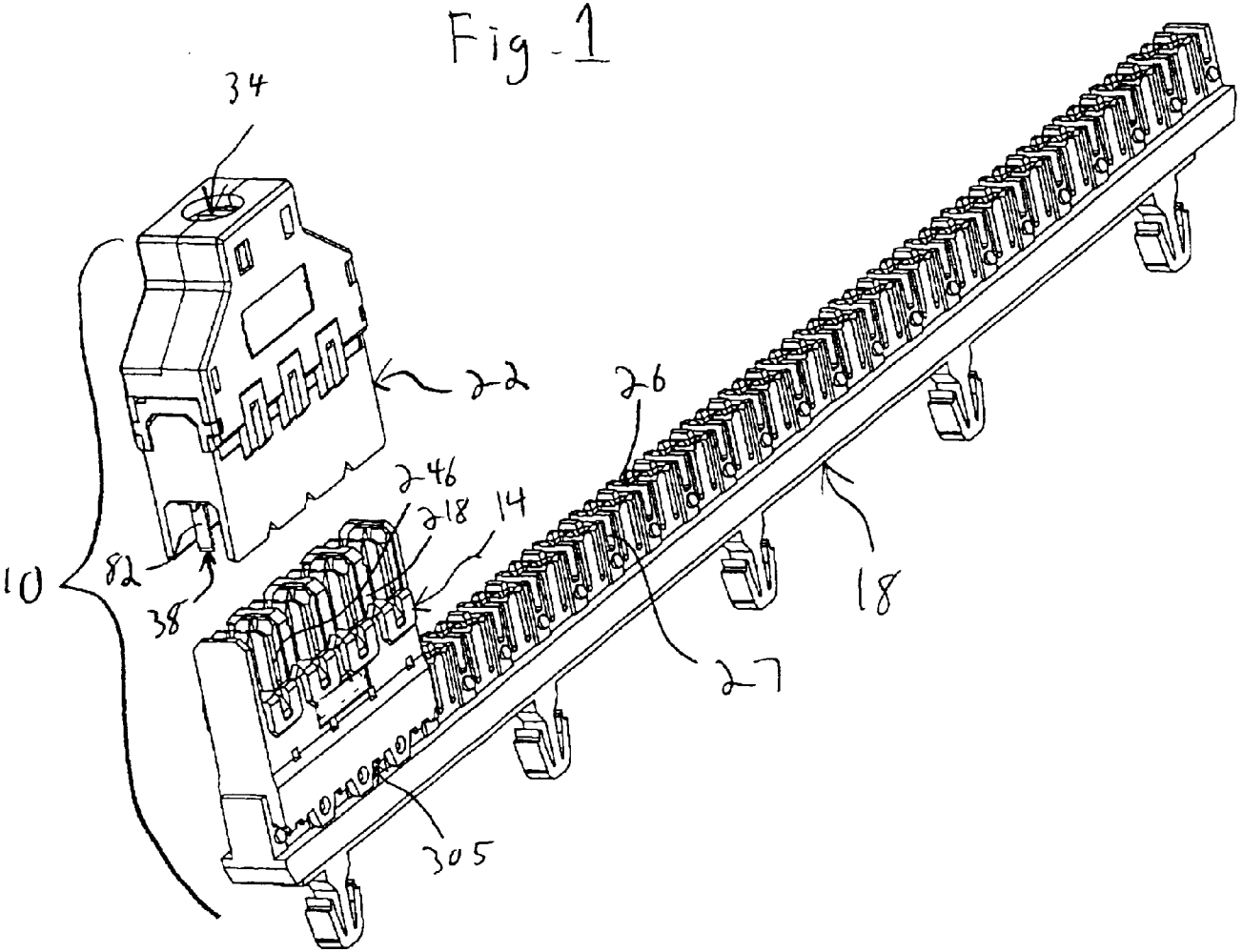
FIG. 1 illustrates a partially exploded isometric view of a connector system formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a partially exploded isometric view of a connector system 10 formed according to an embodiment of the present invention. The connector system 10 is configured to connect incoming and outgoing insulated wires (not shown) which are arranged in differential pairs, such as used in the operating systems of the telecommunications industry for data, voice, or power transmission. By way of example only, one wire in each differential pair carries a positive signal and the other wire in each differential pair carries a negative signal. The positive and negative signals are intended to have the same absolute magnitude.

The connector system 10 includes a connector block 14 connected to a lacing strip 18 and a connector plug 22. The lacing strip 18 carries differential pairs of wires (not shown) that are connected to a first electronic component (not shown). The wires in each differential pair are adjacent; for example the wires are twisted about each other. The wires extend through the lacing strip 18 and are terminated in slots 26 formed in the lacing strip 18. The wires are connected to insulation displacement contacts 30 (FIG. 8) in the connector block 14. The connector block 14 includes relief cutouts 305 that extend around the terminated wires such that the exposed ends of the wires do not contact the connector block 14. The lacing strip 18 also includes post slots 27 that receive the connector block 14. The connector plug 22 carries differential pairs of wires (not shown) that are connected to a second electronic component (not shown) and extend into the connector plug 22 at a wire aperture 34. The wires in each differential pair are adjacent; for example the wires are twisted about each other. The wires are connected to insulation displacement contacts 38 in the connector plug 22. The connector plug 22 is connected to the connector block 14 such that the contacts 30 and 38 engage each other and electrically connect the wires extending to the connector plug 22 to the wires extending to the lacing strip 18.

Figure 2:
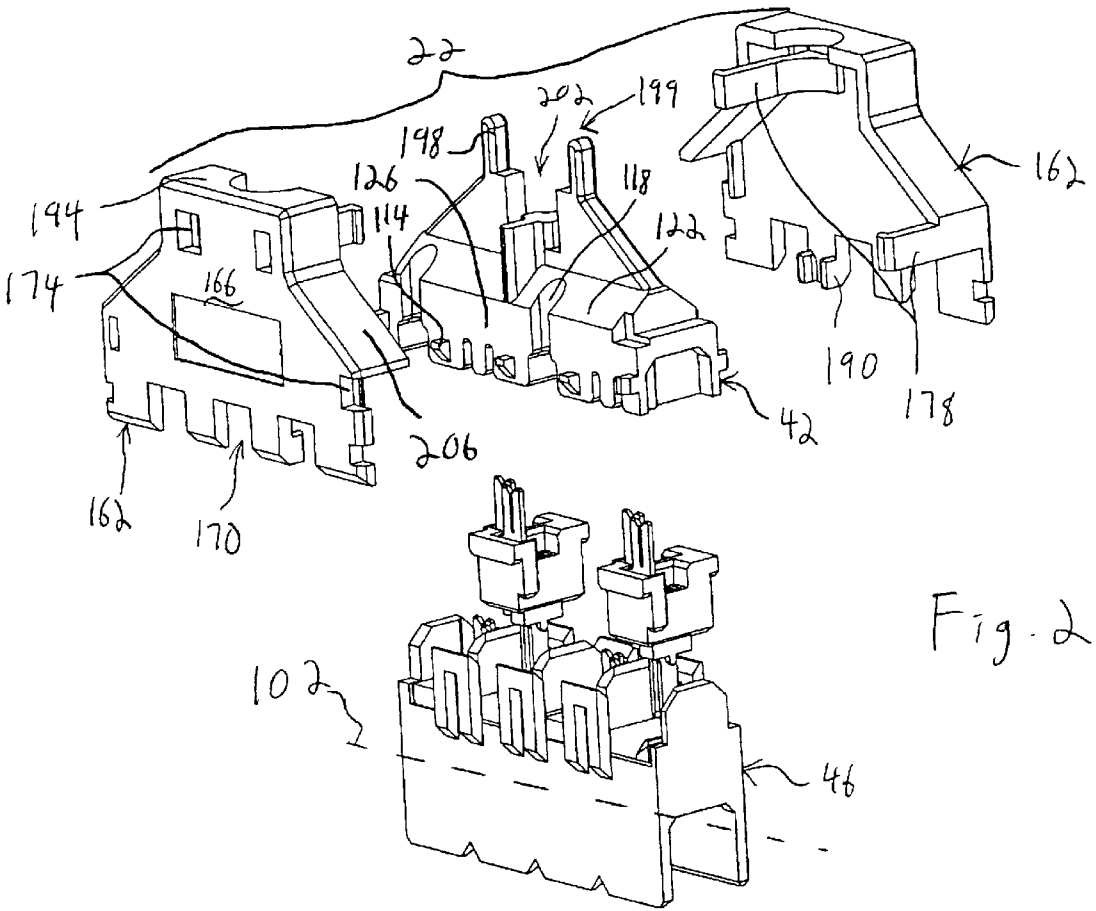
FIG. 2 illustrates an exploded isometric view of a connector plug formed according to an embodiment of the present invention.

FIG. 2 illustrates an exploded isometric view of the connector plug 22 formed according to an embodiment of the present invention. The connector plug 22 includes a plug wire guide 42 and a plug body 46. The plug body 46 is explained in more detail in connection with FIG. 11 and the plug wire guide 42 is explained in more detail in connection with FIG. 4.

Figure 11:
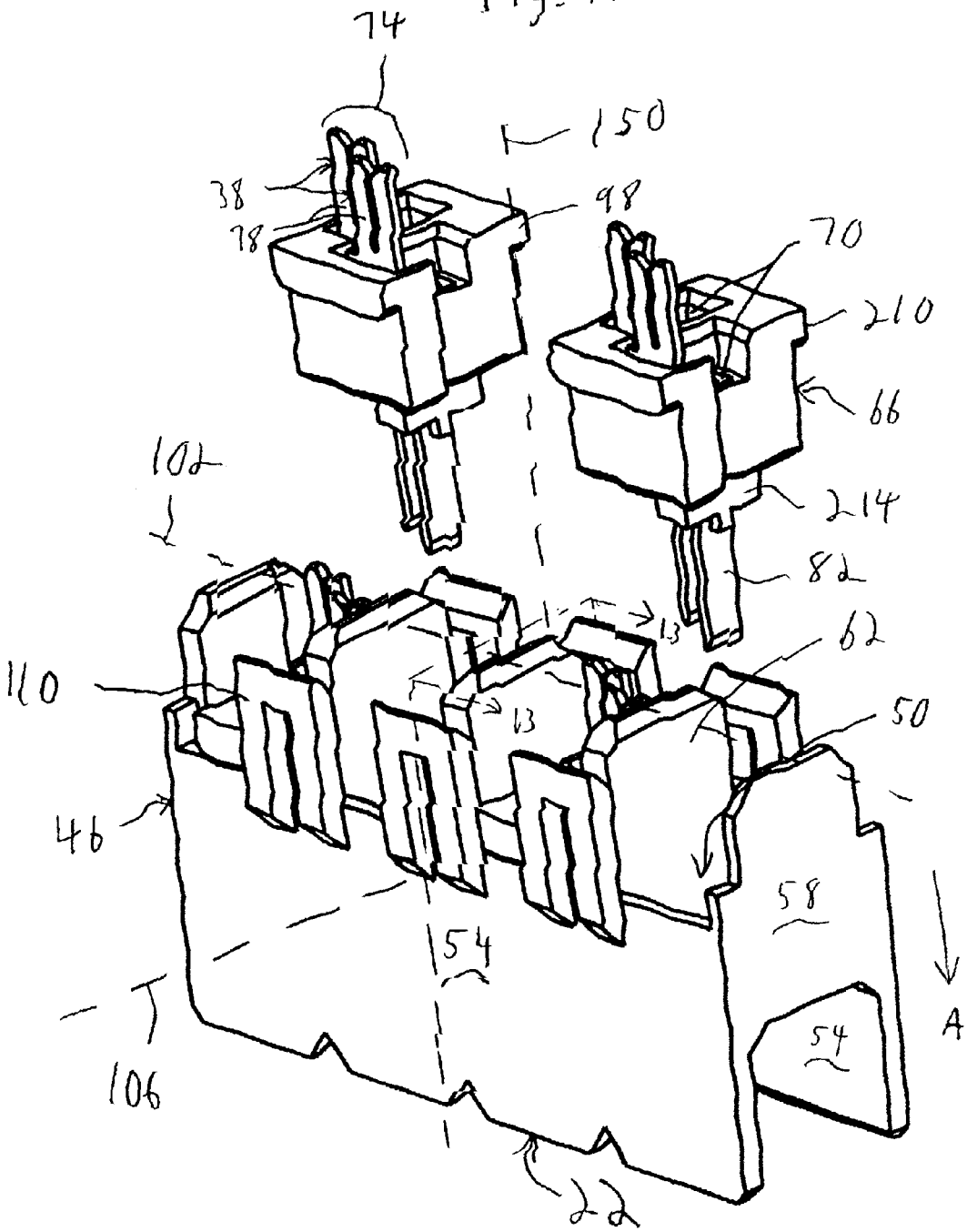
Figure 11 illustrates a partially exploded isometric view of a housing and inserts formed according to an embodiment of the present invention.

Figure 11 illustrates a partially exploded isometric view of the plug body 46 and inserts 66 formed according to an embodiment of the present invention. The plug body 46 is formed of an insulating material and has parallel side walls 54 formed with parallel end walls 58. Parallel divider walls 62 extend between the side walls 54 to define channels 50.

Figure 13:
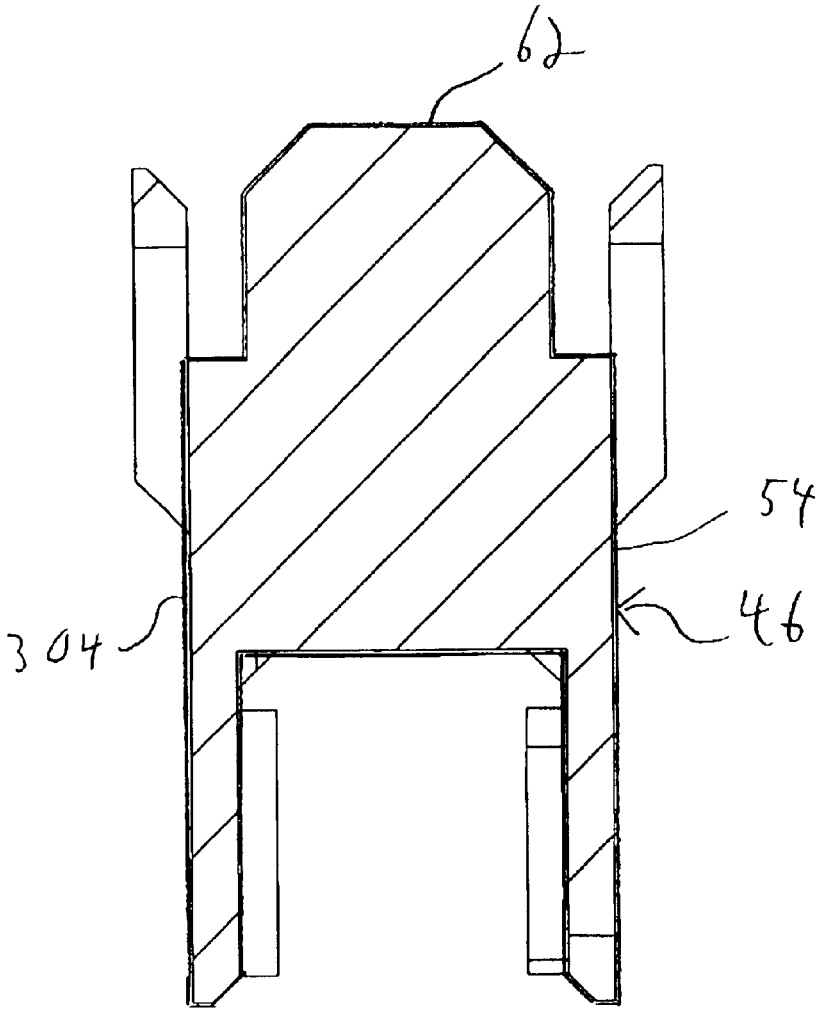
FIG. 13 illustrates a cross sectional view of the plug body of FIG. 11 taken along lines 13—13 of FIG. 11.

FIG. 13 illustrates a cross sectional view of the plug body 46 of FIG. 11 taken along lines 13—13 of FIG. 11. The plug body 46, including all side walls 54, end walls 58 (FIG. 11) and divider walls 62, is covered with a conductive substance 304. By way of example only, the conductive substance 304 may be metal plating such as copper or nickel. Alternatively, not all of the plug body 46 may be covered by the conductive substance 304. For example, only the side and divider walls 54 and 62 may be covered with the conductive substance 304.

Returning to FIG. 11, the channels 50 receive the box-shaped insulated inserts 66. The inserts 66 each include upper trays 210 formed with contact support walls 214. Each insert 66 has a pair of contact slots 70 that extend through the upper tray 210 along the contact support walls 214 parallel to a vertical axis 150. The contact slots 70 carry differential pairs 74 of contacts 38. Each contact 38 of a differential pair 74 is carried within a contact support wall 214.

Figure 3:
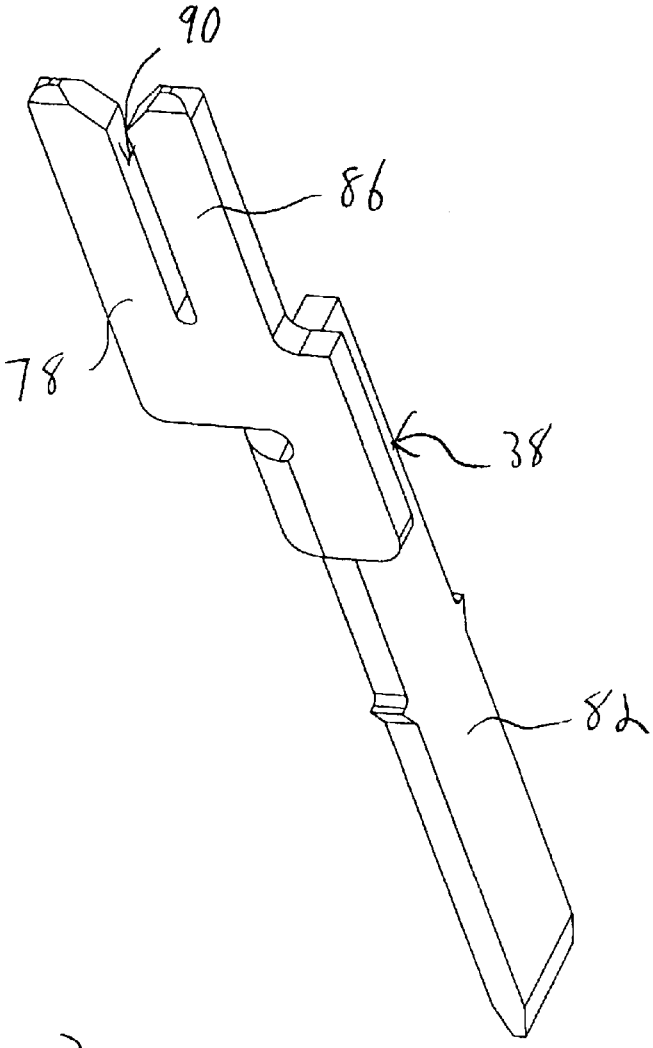
FIG. 3 illustrates an isometric view of an insulation displacement contact (IDC) formed according to an embodiment of the present invention.

FIG. 3 illustrates an isometric view of a contact 38 formed according to an embodiment of the present invention. The contact 38 is conductive and has a catch 78 formed perpendicularly with a rectangular bar 82. The catch 78 is defined by prongs 86 separated by a gap 90.

Returning to FIG. 11, the bars 82 of the contacts 38 extend through the contact slots 70 and the catches 78 extend up beyond the inserts 66. The bars 82 are all retained in the inserts 66 to be aligned along the longitudinal axis 102 and are parallel to each other. Adjacent inserts 66 carry separate differential pairs 74 of catches 78 on offset sides of the longitudinal axis 102 to create a staggered pattern of differential pairs 74. That is to say, adjacent catches 78 of adjacent differential pairs 74 are separated by a greater distance along the longitudinal and transverse axes 102 and 106 than catches 78 within the same differential pair 74.

Figure 12:
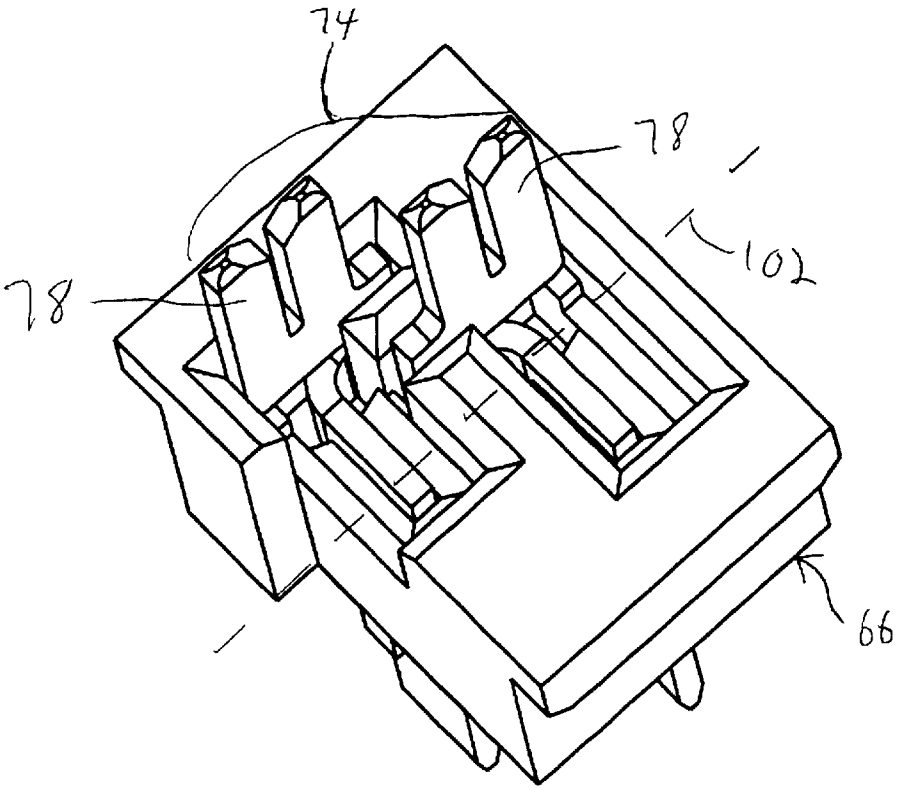
FIG. 12 illustrates a top isometric view of an insert formed according to an embodiment of the present invention.

For example, as shown in FIG. 12, a differential pair 74 of catches 78 is held in an insert 66 with both catches 78 of the differential pair 74 on one side of the longitudinal axis 102. An adjacent insert 66 in the plug body 46 (FIG. 11) carries its differential pair 74 of catches 78 on the opposite side of the longitudinal axis 102 such that adjacent differential pairs 74 of catches 78 within the plug body 46 are on opposite sides of the longitudinal axis 102. The differential pairs of catches 78 are received in differential pairs 158 of contact channels 154 (FIG. 4) that are likewise offset from each other on opposite sides of the longitudinal axis 102.

Returning to FIG. 11, the inserts 66 include rectangular retention beams 98 on opposite sides thereof that extend outward away from each other. When the inserts 66 are pressed downward in the direction of arrow A into the channels 50, the retention beams 98 engage and suspend the inserts 66 on upper edges of the side walls 54 of the plug body 46. Latch catches 110 are formed on and extend upward from the sidewalls 54. The latch catches 110 are oriented perpendicularly with the divider walls 62. The latch catches 110 receive latches 114 (FIG. 2) extending from the plug wire guide 42 (FIG. 2) to retain the plug wire guide 42 to the plug body 46.

Returning to FIG. 2, the plug wire guide 42 is non-conductive and triangular in shape with cable support posts 198 extending from a top end 199 thereof. The cable support posts 198 are separated by a wire gap 202. The plug wire guide 42 has sloped side walls 122 on opposite sides thereof. Latches 114 extend from the side walls 122 and engage the latch catches 110 (FIG. 11) on the plug body 46 (FIG. 11). The side walls 122 each have guide slots 118 cut therein. Optionally, the guide slots 118 on opposite side walls 122 may be offset with one another along the longitudinal axis 102. The guide slots 118 on each side wall 122 are separated by divider blocks 126. Each guide slot 118 receives a differential pair of wires that extend from a cable (not shown) inserted into the wire aperture 34 (FIG. 1) of the connector plug 22. The wires within each differential pair remain twisted about each other in the guide slots 118.

Figure 4:
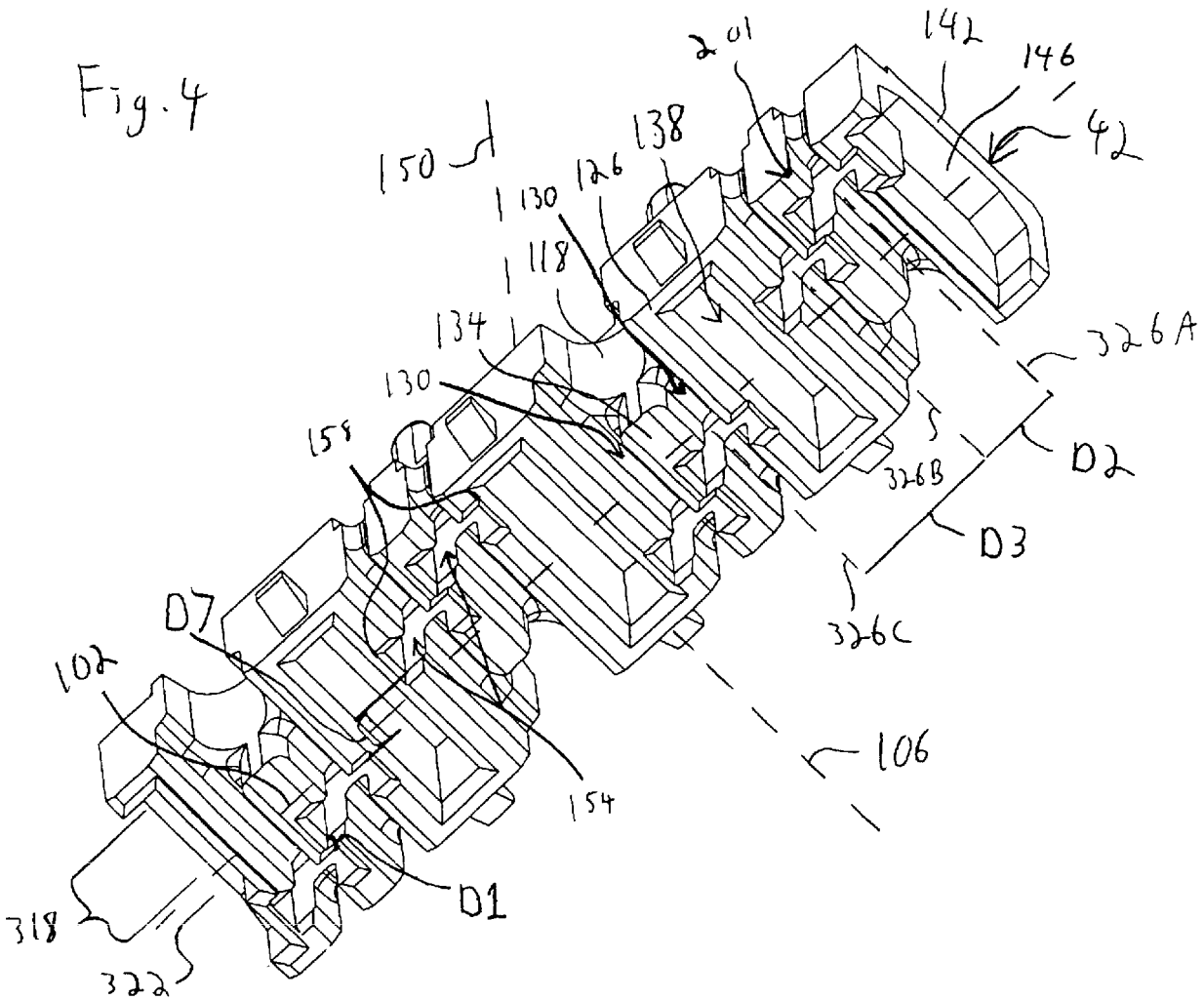
FIG. 4 illustrates a bottom isometric view of a plug wire guide formed according to an embodiment of the present invention.

FIG. 4 illustrates a bottom isometric view of the plug wire guide 42 formed according to an embodiment of the present invention. Each guide slot 118 is split into wire dress grooves 130 by a wire divider 134 at a bottom end 201 of the plug wire guide 42. The guide slots 118 isolate the differential pairs of wires from one another and maintain the wires of each differential pair twisted up to the wire dividers 134. The wires of each differential pair are untwisted and separated from each other at the wire divider 134 such that each wire dress groove 130 holds a single wire. Thus, only a short length of each wire is untwisted and accessible to an operator for routing. The divider blocks 126 contain open ended rectangular cavities 138 that receive the divider walls 62 (FIG. 11) of the plug body 46 (FIG. 11) when the plug body 46 is connected to the plug wire guide 42. Opposite ends of the plug wire guide 42 include end walls 142 that contain wall gaps 146 that are configured to receive the end walls 58 (FIG. 11) of the plug body 46 when the plug body 46 is connected to the plug wire guide 42.

Differential pairs 158 of contact channels 154 extend through the plug wire guide 42 parallel to the vertical axis 150. Each differential pair 158 is offset from an adjacent differential pair 158 on either side of the longitudinal axis 102 to form first and second rows 318 and 322 of differential pairs 158. The adjacent contact channels 154 of adjacent differential pairs 158 are also separated from each other along the transverse axis 106 by the distance D7. The contact channels 154 of each individual differential pair 158 are offset from each other along the longitudinal axis 102 and the transverse axis 106. The differential pairs 158 of contact channels 154 are positioned to be aligned with, and receive, corresponding differential pairs 74 (FIG. 11) of catches 78 (FIG. 11) extending from the inserts 66 (FIG. 11). The contact channels 154 receive the catches 78 when the plug wire guide 42 is connected to the plug body 46 (FIG. 2). The contact channels 154 of a differential pair 158, and thus the catches 78 of a differential pair 74, are separated from each other along the transverse axis 106 by a channel-to-channel distance of D1. Additionally, the contact channels 154 of a differential pair 158 are separated from the longitudinal axis 102 by differing distances. The distance D1 maintains the catches 78 held in a differential pair 158 of contact channels 154 at a predetermined proximity to one another such that the electrical signals experience a relatively uniform impedance when passing from the wires through the contacts 38 (FIG. 11). Therefore, the alignment of the catches 78 within a differential pair 158 of contact channels 154 reduces return loss.

The contact channels 154 of a differential pair 158 have centerlines 326A and 326B separated by a distance D2. Adjacent contact channels 154 of adjacent differential pairs 158 have centerlines 326B and 326C separated by a distance D3. The distance D3 is greater than the distance D2. Therefore, the distances D3 and D7 separate the catches 78 (FIG. 11) such that the contacts 38 (FIG. 11) carried within a differential pair 158 of contact channels 154 are more closely electro-magnetically coupled to one another than to the contacts 38 carried within an adjacent differential pair 158 of contact channels 154. Thus cross talk is reduced between the contacts 38 of adjacent differential pairs 158.

The wire dress grooves 130 intersect the contact channels 154 such that when the plug wire guide 42 is connected to the plug body 46 (FIG. 2), the wires held in the wire dress grooves 130 are received in the gaps 90 (FIG. 3) of the contacts 38 (FIG. 3). The prongs 86 (FIG. 3) of the contacts 38 engage, and arc electrically connected to, the wires.

Returning to FIG. 2, the connector plug 22 also includes mating plug covers 162 The plug covers 162 are triangular in shape and arc snapably connectable to one another over the plug wire guide 42. The plug covers 162 have outer walls 166 formed with side walls 206 and top walls 194. Lower ends of the outer walls 166 have gaps 170 that receive the latch catches 110 (FIG. 11) on the plug body 46. Each outer wall 166 has square cutouts 174 and rectangular latches 178. The outer walls 166 also have catches 190 that extend inward toward each other. The plug covers 162 are positioned together over the plug wire guide 42 such that the catches 190 slide under the side walls 122 of the plug wire guide 42 and the top walls 194 rest upon the cable support posts 198 of the plug wire guide 42. The latches 178 are snapably received in the cutouts 174. The top walls 194 have semicircular cutouts that define the wire aperture 34 (FIG. 1) when the plug covers 162 are connected to the plug wire guide 42.

Figure 5:
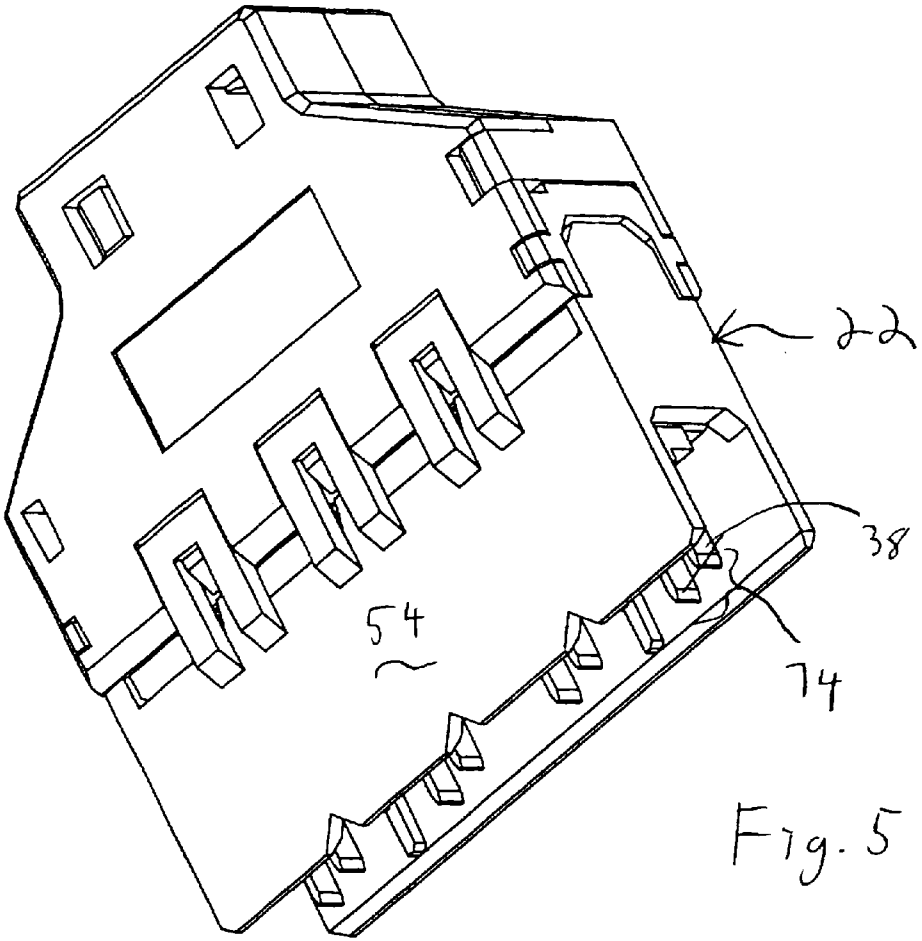
FIG. 5 illustrates an isometric view of a connector plug formed according to an embodiment of the present invention.

FIG. 5 illustrates an isometric view of the connector plug 22 formed according to an embodiment of the present invention. The connector plug 22 is fully assembled. The differential pairs 74 of contacts 38 are shown extending between the side walls 54 of the connector plug 22.

Figure 6:
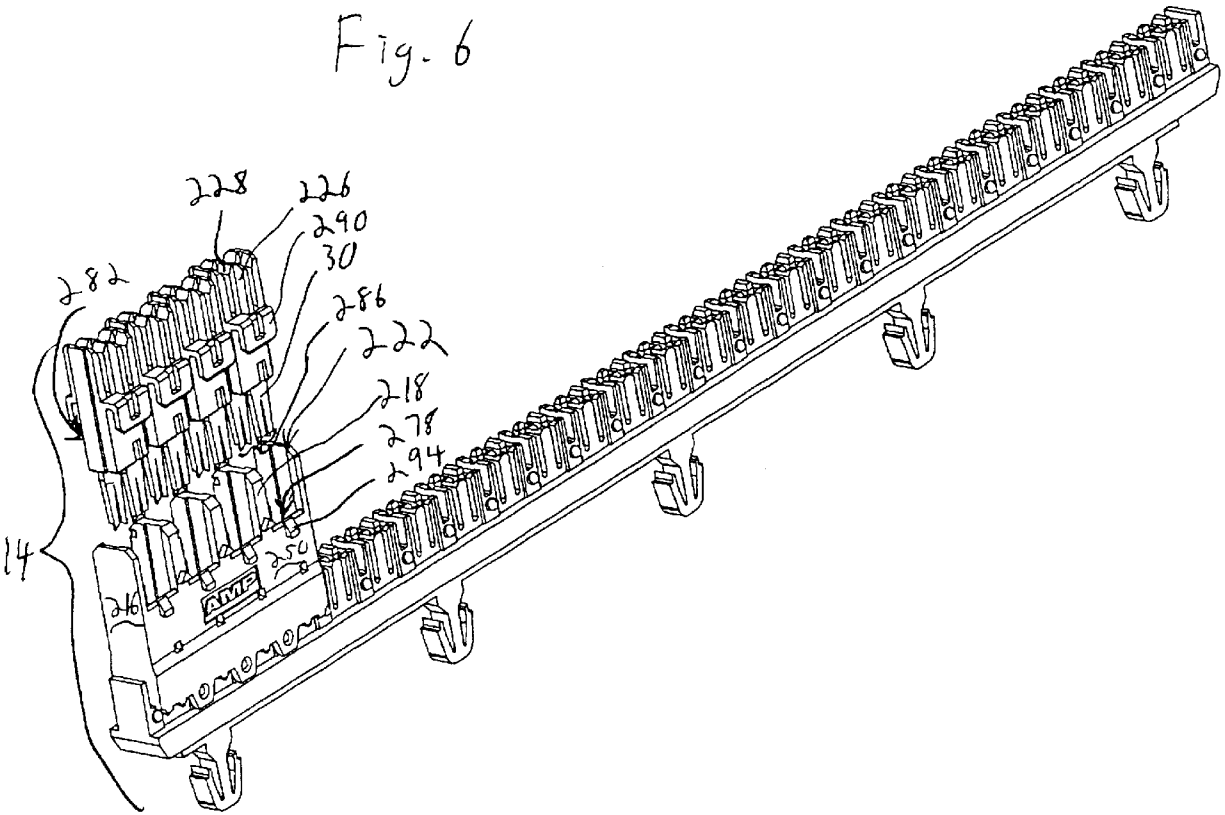
FIG. 6 illustrates an exploded isometric view of a connector block and a lacing strip formed according to an embodiment of the present invention.

FIG. 6 illustrates an exploded isometric view of the connector block 14 and the lacing strip 18 formed according to an embodiment of the present invention. The connector block 14 includes end walls 216 and posts 218 that extend upward near a top end 222. The posts 218 are located proximate opposite ends of the connector block 14 and extend between side walls 250 to define channels 278. Each channel 278 receives a plastic insert 282 carrying a differential pair 286 of contacts 30. Each insert 282 includes interleaved first and second tapered insulators 226 and 228 extending upward therefrom. The first and second tapered insulation 226 and 228 are offset from one another. Each insert 282 also includes latch catches 290 on opposite sides thereof. The inserts 282 are positioned within the channels 278 such that the latch catches 290 receive latches 294 extending from the side walls 250 of the connector block 14.

Figure 7:
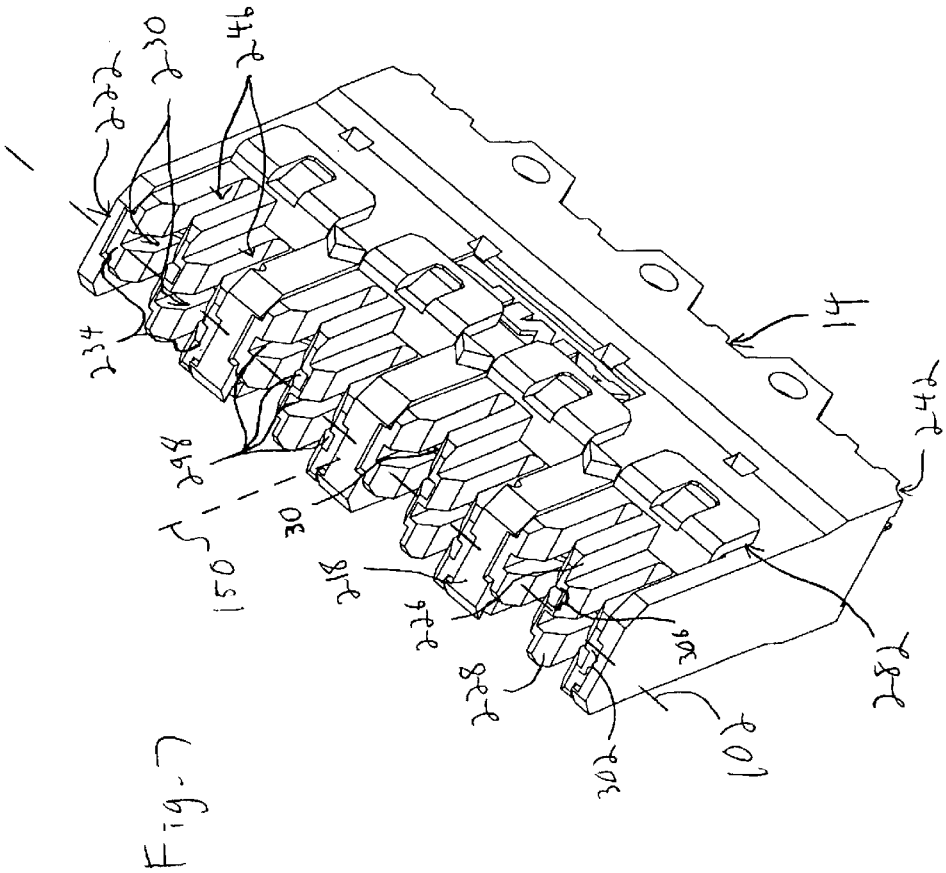
FIG. 7 illustrates an isometric view of a connector block formed according to an embodiment of the present invention.

FIG. 7 illustrates an isometric view of the connector block 14 formed according to an embodiment of the present invention. The first and second tapered insulators 226 and 228 extend upward at the top end 222 of the connector block 14. First and second tapered insulators 226 and 228 of adjacent inserts 282, are separated by the posts 218. The first and second tapered insulators 226 and 228 on a common insert 282 are formed integral with one another. Retention slots 246 and contact channels 230 extend through the connector block 14 parallel to the vertical axis 150 between the first and second tapered insulators 226 and 228. The contact channels 230 hold the contacts 30 arranged in differential pairs 234. The contact channels 230 intersect the retention slots 246. The contacts 30 extend through the connector block 14 parallel to the vertical axis 150. The connector block 14 receives the contacts 38 (FIG. 3) of the connector plug 22 (FIG. 5) in the top end 222 and the wires in a bottom end 242. The contacts 38 are arranged in the differential pairs 74 (FIG. 5) and the wires are likewise arranged in differential pairs. The contacts 38 in the differential pairs 74 are inserted into corresponding retention slots 246 to engage corresponding contacts 30 proximate the top end 222. Similarly, the wires in the differential pairs engage corresponding contacts 30 at the bottom end 242.

Figure 8:
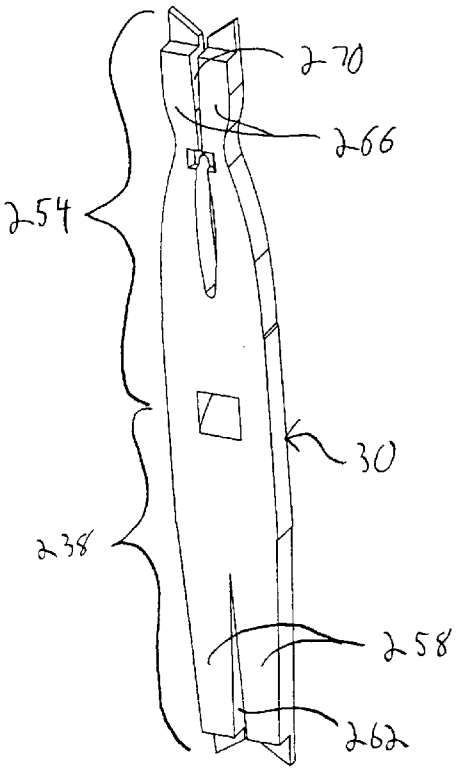
FIG. 8 illustrates an isometric view of an IDC contact formed according to an embodiment of the present invention.

FIG. 8 illustrates an isometric view of a contact 30 formed according to an embodiment of the present invention. The contact 30 is formed from a thin piece of metal having a top portion 254 and a bottom portion 238. Two catch legs 258 extend from the bottom portion 238 to define a V-shaped wire catch 262 therebetween that receives a corresponding wire. The bottom portion 238 extends from the bottom end 242 (FIG. 7) of the connector block 14. Two catch legs 266 also extend from the top portion 254 to define another V-shaped wire catch 270. The contacts 30 are retained within the connector block 14 (FIG. 6) such that the top portion 254 is positioned within the retention slot 246 (FIG. 7) to receive the bar 82 (FIG. 3) of a contact 38 in the wire catch 270. Conversely, the wires are pushed into the wire catches 262 at the bottom end 242 until the catch legs 258 cut through insulation covering of the wires to electrically engage the wires.

Returning to FIG. 7, the first and second tapered insulators 226 and 228 are offset from each other transversely to the longitudinal axis 102 extending through a central plane of the connector block 14. The first and second tapered insulators 226 and 228 include recesses 298 that define the contact channels 230. The recesses 298 define a first group of contact channels 230 arranged in line with one another in a first row 302 and spaced on one side of the longitudinal axis 102. The recesses 298 define a second group of contact channels 230 arranged in line with one another in a second row 306 and spaced on another side of the longitudinal axis 102.

Figure 9:
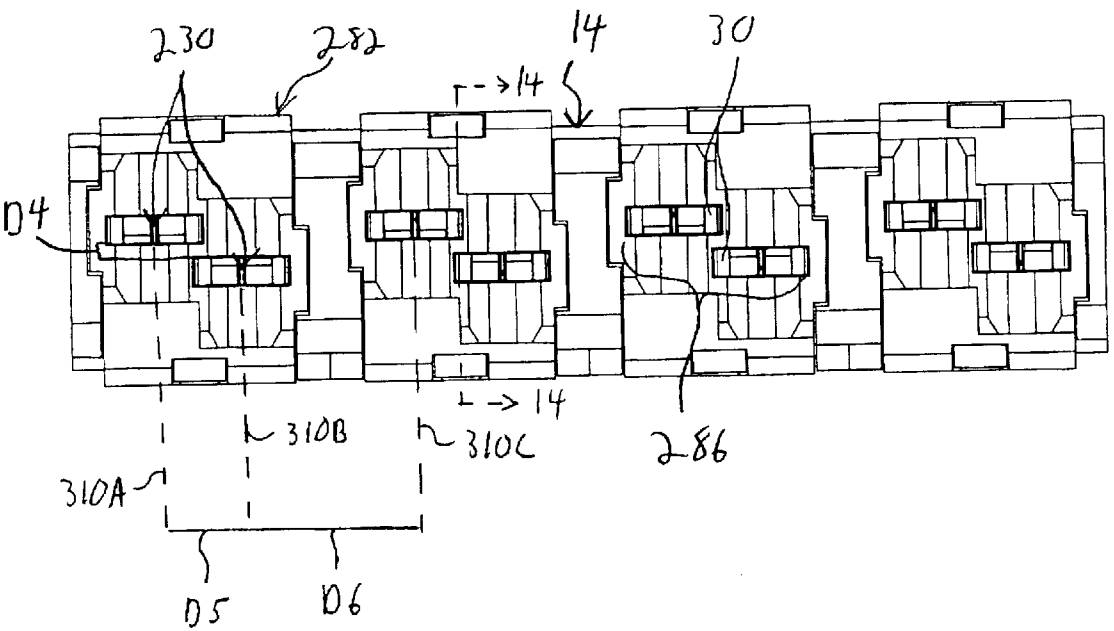
FIG. 9 illustrates a top plan view of the connector block of FIG. 7.

FIG. 9 illustrates a top plan view of the connector block 14 of FIG. 7. The contact channels 230 of an insert 282 carry the differential pairs 286 of contacts 30. The contact channels 230 of an insert 282, are separated from each other by a channel-to-channel distance of D4. The distance D4 maintains the contacts 30 of a differential pair 286 at a proximity to one another such that the electrical signals experience a relatively uniform impedance when passing between the wires through the contacts 30. Therefore, the alignment of the contacts 30 within a differential pair 286 optimizes return loss.

Contacts 30 of a differential pair 286 have centerlines 310A and 310B separated by a distance D5, while proximate contacts 30 of adjacent differential pairs 286 have centerlines 310B and 310C separated by a distance D6. The distance D6 is greater than the distance D5. Because the distance D6 is greater than the distance D5, the contacts 30 within a differential pair 286 arc more closely electromagnetically coupled to one another than to the contacts 30 of an adjacent differential pair 286. Thus cross talk is reduced between the contacts 30 of adjacent differential pairs 286.

Returning to FIG.7, in the alternative, the contact channels 230 may be arranged similarly to the channels 154 (FIG. 4) of the plug wire guide 42 (FIG. 4). For example, adjacent differential pairs 234 of contact channels 230 may be located on opposite sides of the longitudinal axis 102 with the individual contact channels 230 of a differential pair 234 staggered with respect to each other. The contacts 38 (FIG. 5) within the connector plug 22 (FIG. 5) are correspondingly aligned in order to be received within the contact channels 230.

Figure 14:
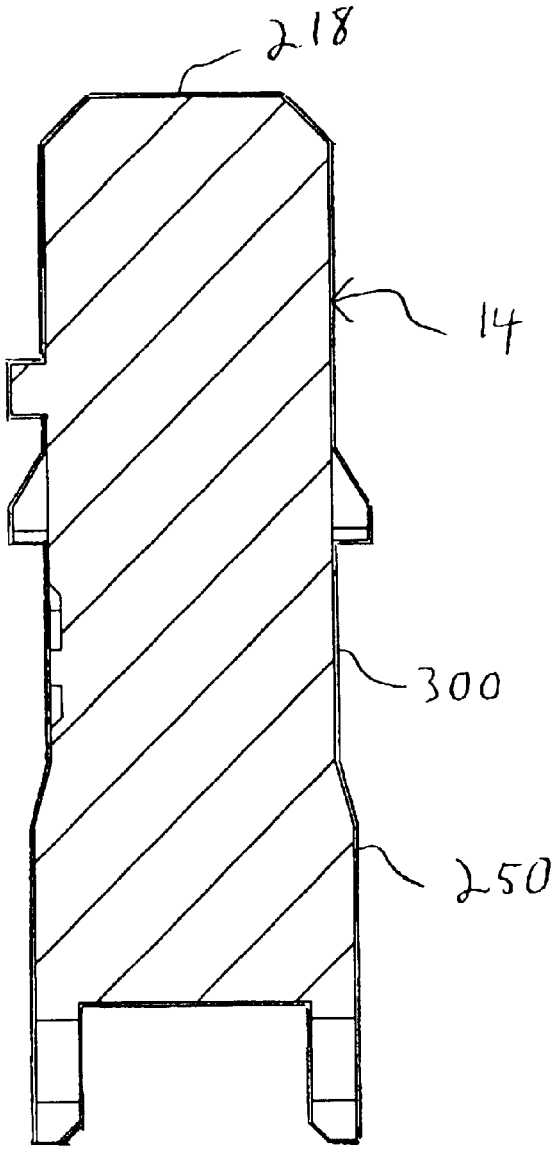
FIG. 14 illustrates a cross sectional view of the connector block of FIG. 9 taken along lines 14—14 of FIG. 9.

FIG. 14 illustrates a cross sectional view of the connector block 14 of FIG. 9 taken along lines 14—14 of FIG. 9. The connector block 14, including the side walls 250, end walls 216 (FIG. 6), and posts 218, is covered with a conductive substance 300. By way of example only, the conductive substance 300 may be metal plating such as copper or nickel. Alternatively, not all of the connector block 14 may be covered by the conductive substance 300. For example, only the side walls 250 and posts 218 may be covered with the conductive substance 300.

Figure 10:
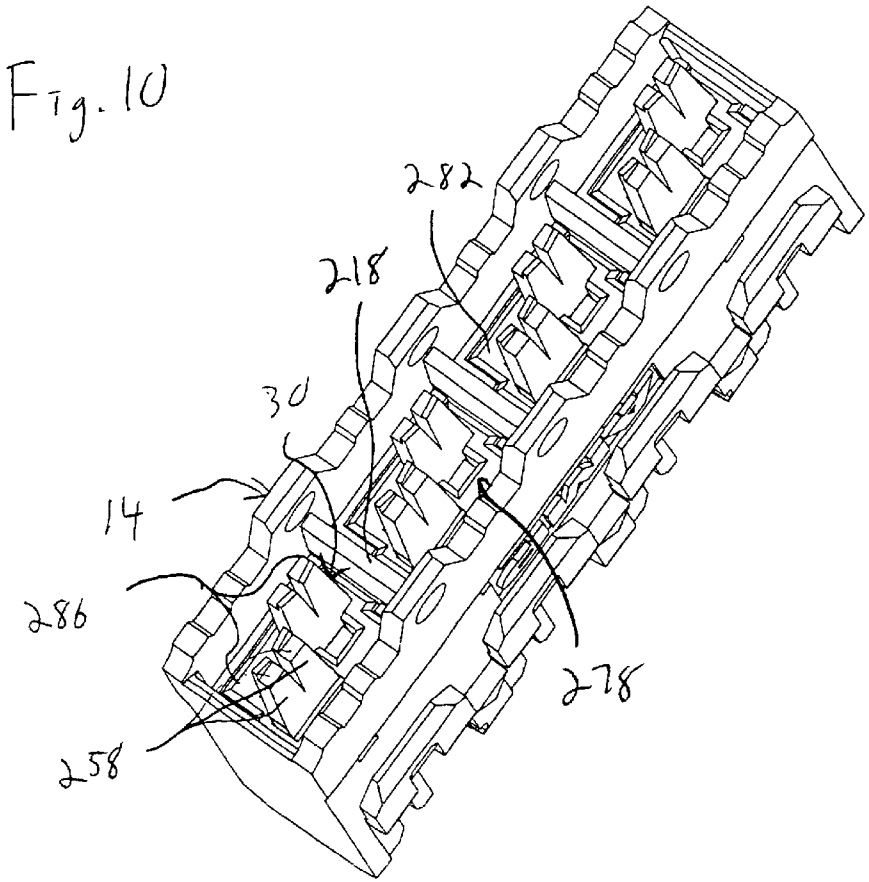
FIG. 10 illustrates a bottom isometric view of the connector block of FIG. 7.

FIG. 10 illustrates a bottom isometric view of the connector block 14 of FIG. 7. The inserts 282 retain the contacts 30 in differential pairs 286 in the channels 278 between the posts 218. During assembly, when the connector block 14 is connected to the lacing strip 18 (FIG. 1), the catch legs 258 of the contacts 30 slide into the slots 26 (FIG. 1) in the lacing strip 18 that hold and engage the wires and the posts 218 slide into the post slots 27 (FIG. 1).

Returning to FIG. 1, in operation the connector plug 22 is connected to the connector block 14 such that the bars 82 of the contacts 38 slide into the retention slots 246 of the connector block 14 perpendicularly to the contacts 30 (FIG. 8) and are received in the wire catches 270 (FIG. 8) of the contacts 30. The divider walls 62 (FIG. 11) covered with the conductive substance 304 (FIG. 13) engage the posts 218 covered with the conductive substance 300 (FIG. 14) in order that a continuous conductive shield surrounds the engaged differential pairs 74 (FIG. 2) and 286 (FIG. 6) of contacts 38 and 30, respectively. Thus, the differential pairs of wires extending to the lacing strip 18 are connected to corresponding differential pairs of wires extending to the connector plug 22. 1561 As shown in FIG. 11, the conductive substance 304 (FIG. 13) on the divider walls 62, side walls 54, and end walls 58 of the plug body 46 separates the differential pairs 74 of contacts 38 in the connector plug 22 and acts as a barrier or shield to prevent cross talk and interference between adjacent differential pairs 74. As electrical signals travel between the wires through the connected differential pairs 74 and 286 (FIG. 9) of contacts 38 and 30 (FIG. 9), respectively, the electrical signals create local EM fields that induce a capacitive charge onto the conductive substance 304 (FIG. 13) on the side and end walls 54 and 58 and divider walls 62 located proximate to the contacts 38 and 30. For example, one contact 38 in a differential pair 74 carries a negative signal which creates a positive charge on a proximate divider wall 62 (FIG. 11) and the other contact 38 of the differential pair 74 carries a positive signal which creates a negative charge on the opposite divider wall 62 surrounding the differential pair 74. Because the conductive substance 304 (FIG. 13) on the divider walls 62 and the entire connector plug 22 is connected, the charges collected, negative and positive, separately on the opposite divider walls 62 negate each other to result in a substantially zero net charge.

Returning to FIG. 6, the posts 218, side walls 250 and end walls 216 covered with the conductive substance 300 (FIG. 14) surrounding the differential pairs 286 of the contacts 30 in the connector block 14 operate in the same fashion as the above example to negate charges collected on the connector block 14. Additionally, a charge imparted on a post 218 by an adjacent contact 30 of a first differential pair 286 in the connector block 14 can negate an opposite charge imparted on a divider wall 62 (FIG. 11) by an adjacent contact 38 (FIG. 11) of a first differential pair 74 (FIG. 11) in the connector plug 22 (FIG. 11).

The electrically common shield created by the conductive substance 304 (FIG.

13) on the connector plug 22 (FIG. 1) and the conductive substance 300 (FIG. 14) on the connector block 14 is not connected to ground or any other fixed charge potential. Optionally, the interconnected shielding of the engaged connector plug 22 and connector block 14 may be grounded by connecting a ground wire to any point on the outside of the metal plated connector plug 22 or connector block 14.

In an alternative embodiment, only the posts 218 and the divider walls 62 may be plated such that the contacts 30 and 38, respectively, are shielded on only two opposite sides. In another embodiment, only one of the connector plug 22 and connector block 14 may have metal plating. In another embodiment, the connector plug 22 may not carry contacts 38; rather the plug wire guide 42 directs the wires directly into contact with the contacts 30 within the connector block 14. Additionally, the wires may be connected directly to the contacts 30 in the connector block 14 without the use of the connector plug 22. Furthermore, the structure of the connector plug 22 and connector block 14 may be enlarged to include more contacts 30 and 38 to connect more differential pairs of wires.

The connector system confers several benefits. First, positioning IDC contacts in a differential pair closer to each other along a longitudinal axis and a transverse axis than adjacent IDC contacts of adjacent differential pairs increases EM coupling between the IDC contacts in any one differential pair and reduces cross talk between IDC contacts of adjacent differential pairs. The alignment of the IDC contacts in parallel rows with the IDC contacts of a differential pair positioned closer to each other along the longitudinal axis also generally matches the impedance experienced by the electrical signals passing through the IDC contacts and thus reduces reflection or return loss of the electrical signals.

Also, by plating the connector plug and connector block with metal, the IDC contacts are enclosed on all sides by metal shielding and thus are better isolated from each other than if surrounded only on two sides by shields. The interconnected plate shielding negates charges placed on the connector plug and connector block by IDC contacts to reduce cross talk between differential pairs of IDC contacts in the connector plug and connector block. The plating of the connector plug and connector block also eliminates the need to insert bulky shield configurations into the connector plug and connector block and allows for easy grounding of the plate shielding.

Furthermore, by isolating each twisted differential pair of wires in a guide channel in the wire plug guide, the differential pairs of wires are only untwisted and separated for a short distance in the wire dress grooves. Thus, the wires in each differential pair are better EM coupled with each other and an operator has less wire length to potentially misroute.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A connector plug, comprising:

a plug body holding multiple contacts arranged in at least one differential pair, said contacts extending along a vertical axis of said plug body; and a wire guide having a first end configured to join an end of said plug body, said wire guide having a second end configured to receive a cable containing at least one differential pair of adjacent wires, said wire guide having at least one guide slot, said at least one guide slot carrying a corresponding differential pair of wires, said first end of said wire guide including channels that open onto said second end to receive said contacts, said contact channels for said at lease one differential pair of contacts being separated from each other along a transverse axis of said wire guide such that said contact channels are displaced from each other with respect to a longitudinal axis perpendicular to said transverse axis, said first end having wire dress grooves extending from said at least one guide slot to said channels, each of said wire dress grooves receiving a single wire.

2. The connector plug of claim 1, wherein said wire dress grooves align said wires across said channels to engage said contacts inserted into said channels.

3. The connector plug of claim 1, wherein said at least one guide slot extends along said vertical axis and said wire dress grooves extend from said at least one guide slot along a transverse axis at said first end of said wire guide.

4. The connector plug of claim 1, wherein said wire guide includes divider blocks on opposite sides thereof, adjacent guide slots on said wire guide being separated by said divider blocks.

5. The connector plug of claim 1, wherein said wire guide includes wire dividers, said wire dividers extending into said at least one guide slot to divide said at least one guide slot into said wire dress grooves.

6. The connector plug of claim 1, wherein said wire guide is formed along a longitudinal axis, said channels being grouped in differential pairs including first and second channels located on a common side of said longitudinal axis adjacent differential pairs of channels being located on opposite sides of said longitudinal axis.

7. The connector plug of claim 1. wherein said plug body has contact slots extending therethrough along said vertical axis and said channels of said wire guide extend therethrough along said vertical axis and parallel to said contact slots, said channels being aligned in differential pairs and said contact slots being aligned in differential pairs, said channels and contact slots being aligned with each other to receive said contacts in differential pairs.

8. The connector plug of claim 1, wherein said connector plug is mounted to a connector block that carries block contacts that engage said contacts retained in said connector plug, said connector block being plated with an interconnected conductive substance that forms an electrically common shield surrounding said block contacts.

9. A connector, comprising:

a housing formed along a longitudinal axis thereof, said housing including channels that open onto a first end of said housing to receive contacts, said channels being grouped in differential pairs including first and second channels located on a common side of said longitudinal axis adjacent differential pairs of channels being located on opposite sides of said longitudinal axis.

10. The connector of claim 9, wherein said first and second channels in a differential pair are spaced different distances from said longitudinal axis.

11. The connector of claim 9, wherein said channels in each of said differential pairs are staggered with respect to each other.

12. The connector of claim 9, further comprising a plug body including contact slots extending therethrough along a vertical axis, said housing being mounted to said plug body, said channels of said housing extending therethrough along said vertical axis and parallel to said contact slots, said channels being aligned in differential pairs and said contact slots being aligned in differential pairs, said channels and contact slots being aligned with each other to receive said contacts in differential pairs.

13. The connector of claim 9, wherein said housing is mounted to a connector block that carries block contacts that engage said contacts retained in said housing, said connector block being plated with an interconnected conductive substance that forms an electrically common shield surrounding said block contacts.

14. The connector of claim 9, wherein said housing includes a second end configured to receive a cable containing differential pairs of adjacent wires, said housing having guide slots, each guide slot carrying a corresponding differential pair of wires, said first end of said housing having wire dress grooves extending from said guide slots to said channels, each of said wire dress grooves receiving a single wire.

15. A connector plug, comprising:

a plug body holding multiple contacts in contact slots arranged in at least two differential pairs, said contact slots and contacts extending along a vertical axis of said connector plug, and a wire guide having a first end configured to join an end of said plug body, said first end including contact channels arranged in at least two differential pairs and extending along said vertical axis parallel to said contact slots, said contact channels and contact slots being aligned with each other to receive said contacts in differential pairs, said contact channels for each said differential pair of contacts being separated from each other along a transverse axis of said wire guide such that said contact channels are displaced from each other with respect to a longitudinal axis perpendicular to said transverse axis, said wire guide having a second end configured to receive a cable containing differential pairs of adjacent wires, said wire guide having guide slots, each guide slot carrying a corresponding differential pair of wires, said first end having wire dress grooves extending from said guide slots to said contact channels, each of said wire dress grooves retaining a single wire in order that said contacts received in said contact channels engage said wires.

16. The connector plug of claim 15, wherein said connector plug extends along a longitudinal axis, said plug body including inserts that carry said contacts in said contact slots parallel to each other and aligned along said longitudinal axis.

17. The connector plug of claim 15, wherein said guide slots extend along said vertical axis and said wire dress grooves extend from said guide slots along a transverse axis at said first end of said wire guide.

18. The connector plug of claim 15, wherein said connector plug is mounted to a connector block that carries block contacts that engage said contacts retained in said connector plug, said connector block and plug body being plated with an interconnected conductive substance that forms an electrically common shield surrounding said block contacts.

19. The connector plug of claim 15, wherein said wire guide includes wire dividers, said wire dividers extending into said guide slots to divide said guide slots into said wire dress grooves.

20. The connector plug of claim 15, wherein said wire guide is formed along a longitudinal axis, said contact channels being grouped in differential pairs including first and second contact channels located on a common side of said longitudinal axis adjacent differential pairs of contact channels being located on opposite sides of said longitudinal axis.

21. A connector, comprising:

a housing including a channel extending therethrough between first and second ends of said housing; and an insert including contact channels carrying contacts arranged in a differential pair, said channel receiving said insert and positioning said contacts in a predetermined orientation, said housing being at least partially covered with a conductive substance to shield said differential pair of contacts.

22. The connector of claim 21, wherein said housing includes side walls, end walls and divider walls, said side walls, end walls, and divider walls being plated with said conductive substance to provide electrical shielding about said differential pair of contacts within said channel.

23. The connector of claim 1, wherein said housing includes divider walls separating a plurality of said channels, said channels receiving a plurality of said inserts, each of said inserts carrying a corresponding differential pair of contacts, said housing being plated with said conductive substance to electrically shield said differential pairs of contacts from one another.

24. The connector of claim 1, wherein said conductive substance is a metal plating.

* * * * *